US008419300B2

(12) United States Patent
Spence et al.

(10) Patent No.: US 8,419,300 B2
(45) Date of Patent: Apr. 16, 2013

(54) MODULAR WEB ROLLER ASSEMBLY

(75) Inventors: James J. Spence, Honeoye Falls, NY (US); Matthew Ryan McLaughlin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 635 days.

(21) Appl. No.: 12/643,156

(22) Filed: Dec. 21, 2009

(65) Prior Publication Data

US 2011/0150552 A1 Jun. 23, 2011

(51) Int. Cl.

| | |
|---|---|
| ***B65H 23/188*** | (2006.01) |
| *B41J 2/01* | (2006.01) |
| *B41J 15/04* | (2006.01) |
| *B41J 2/07* | (2006.01) |
| *B41M 7/00* | (2006.01) |

(52) U.S. Cl.
USPC ..... 400/76; 226/24; 226/45; 400/611; 347/104; 347/102; 347/14

(58) Field of Classification Search ..... 347/104, 347/108, 102; 242/412, 412.1, 416, 418, 242/420, 420.5; 226/24, 42, 45; 400/693, 400/76, 611
See application file for complete search history.

(56) References Cited

U.S. PATENT DOCUMENTS

| | | | | |
|---|---|---|---|---|
| 3,598,332 | A | 8/1971 | Sharkey | |
| 3,986,650 | A | 10/1976 | Swanke et al. | |
| 4,033,492 | A * | 7/1977 | Imai | 226/25 |
| 4,958,111 | A * | 9/1990 | Gago | 318/6 |
| 7,665,817 | B2 * | 2/2010 | Folkins | 347/14 |
| 2003/0116041 | A1 * | 6/2003 | Manes et al. | 101/198 |
| 2003/0169322 | A1 * | 9/2003 | Shima et al. | 347/102 |
| 2009/0021550 | A1 * | 1/2009 | Leighton et al. | 347/17 |
| 2009/0122126 | A1 * | 5/2009 | Ray et al. | 347/102 |
| 2009/0303285 | A1 * | 12/2009 | Matsuhashi | 347/37 |
| 2010/0110134 | A1 * | 5/2010 | Ohmura et al. | 347/15 |
| 2011/0043586 | A1 * | 2/2011 | Silverbrook et al. | 347/104 |

FOREIGN PATENT DOCUMENTS

| | | | |
|---|---|---|---|
| JP | 06328680 | A * | 11/1994 |
| JP | 2009066864 | A * | 4/2009 |

* cited by examiner

*Primary Examiner* — Daniel J Colilla

(74) *Attorney, Agent, or Firm* — Maginot, Moore & Beck, LLP

(57) ABSTRACT

A modular roll bar assembly for use in a continuous web imaging device includes a plurality of roll bars and a support frame configured to operably support the plurality of roll bars such that the plurality of roll bars define a web path having a non-linear shape with an entrance end and an exit end. The entrance end is configured to receive a substantially continuous web of substrate material, and the plurality of roll bars is configured to guide the continuous web past the exit end. A load cell is operably coupled to the support frame and configured to generate a signal indicative of a down force applied to the support frame. A controller is operably coupled to the load cell to receive the signal and to correlate the down force applied to the support frame indicated by the signal to a tension measurement value for the continuous web.

9 Claims, 12 Drawing Sheets

MODULAR WEB ROLLER ASSEMBLY

TECHNICAL FIELD

The present disclosure relates to printers for printing on a substantially continuous web, and in particular to roller assemblies for use with such printers.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a continuous media web. In a web printer, a continuous supply of media, typically provided in a media roll, is conveyed by a plurality of rollers that are arranged to guide the media web through a print zone where a plurality of printheads are positioned to deposit ink onto the web to form images. Beyond the print zone, the media web is gripped and pulled by mechanical structures so a portion of the media web continuously moves through the print zone. Tension bars or rollers may be placed in the feed path of the moving web to remove slack from the web so it remains taut without breaking.

Most previously known continuous web printers do not readily enable scaleable, modular printer platforms. For example, continuous web printers are typically designed to suit a particular user's needs with the printheads, rollers, roll bars, and the like being custom mounted at specified locations in the frame of the web printer. Such a configuration is not easily changed or modified to accommodate an increase or decrease to the number of printheads or a change in the geometry or arrangement of the web path.

SUMMARY

The present disclosure proposes a modular roll bar assembly that may removably mounted to an imaging device main frame to define at least a portion of the web path of the imaging device, and in particular to provide web path geometry and printhead backing support in the print zone of the imaging device. Various embodiments of the modular roll bar assembly described below enable web tension measurement and web thermal control in the print zone. For example, in one embodiment, a modular roll bar assembly for use in a continuous web imaging device includes a plurality of roll bars and a support frame configured to operably support the plurality of roll bars such that the plurality of roll bars define a web path having a non-linear shape with an entrance end and an exit end. The entrance end is configured to receive a substantially continuous web of substrate material, and the plurality of roll bars is configured to guide the continuous web past the exit end. A load cell is operably coupled to the support frame and configured to generate a signal indicative of a down force applied to the support frame. A controller is operably coupled to the load cell to receive the signal and to correlate the down force applied to the support frame indicated by the signal to a tension measurement value for the continuous web.

In another embodiment, a modular roll bar assembly for use in a continuous web imaging device includes a plurality of roll bars, and a support frame configured to operably support the plurality of roll bars such that the plurality of roll bars define a web path having a non-linear shape with an entrance end and an exit end. The entrance end is configured to receive a substantially continuous web of substrate material, and the plurality of roll bars is configured to guide the continuous web past the exit end. The assembly includes a temperature control system configured to heat or cool the plurality of roll bars to a predetermined temperature.

In yet another embodiment, an imaging device is provided that includes a substantially continuous web, an imaging device main frame, and at least one modular roll bar assembly including a plurality of roll bars, and a support frame configured to operably support the plurality of roll bars such that the plurality of roll bars define a web path having a non-linear shape with an entrance end and an exit end. The at least one modular roll bar assembly is removably attached to the imaging device main frame. A plurality of printheads is supported by the imaging device main frame. Each printhead in the plurality is positioned in the main frame to provide a predetermined gap distance between the printhead from one of the roll bars of one of the modular roll bar assemblies.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
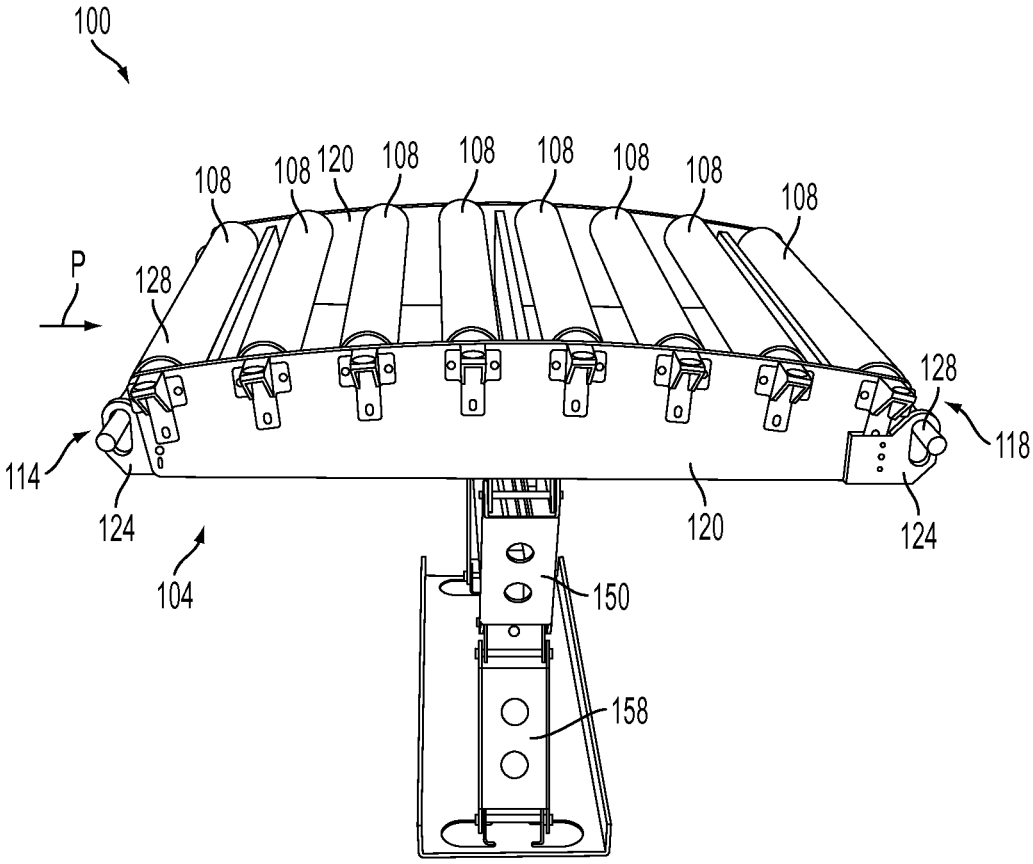
FIG. 1 is a first perspective view of an embodiment of a modular roll bar assembly for use with a continuous web imaging device.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multi-function machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred moves through the imaging device. The cross-process direction, along the same plane as the image receiving surface, is substantially perpendicular to the process direction.

Figure 12:
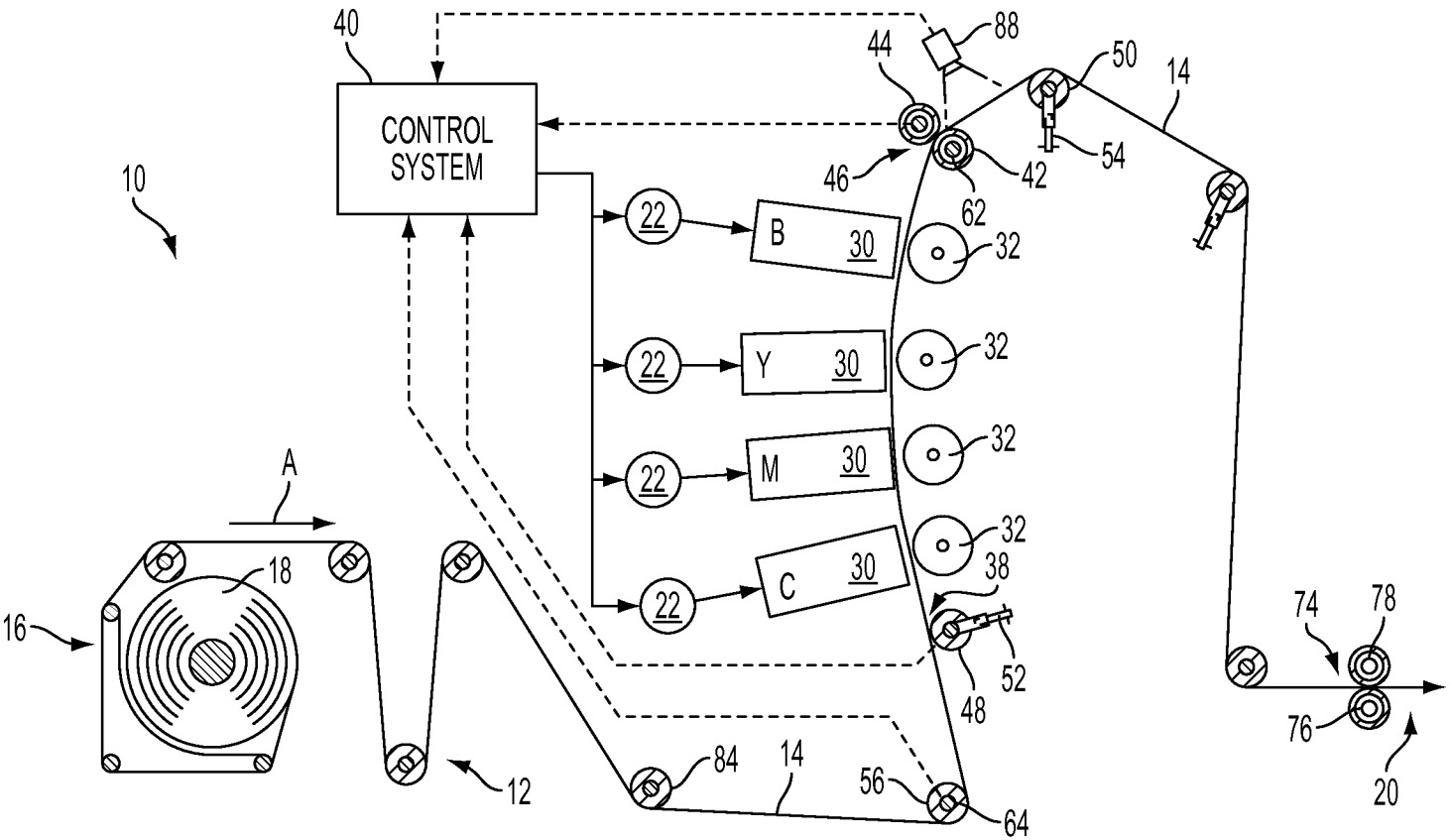
FIG. 12 depicts a schematic diagram of an embodiment of continuous web imaging device in which the modular roll bar assembly of FIG. 1 may be utilized.

With reference to FIG. 12, a schematic diagram of an embodiment of a continuous web imaging device 10 is illustrated in the form of an ink jet printing system. The device 10 includes a conveyor system 12, which conveys a web 14 of paper along a paper path in a process direction indicated generally by arrow A through a print zone located between an upstream end 16, herein illustrated as comprising an unwinder 18, and a downstream end 20, such as a take up roller (not shown). The device 10 includes a plurality of marking stations 22, at least one for each of the ink colors to be applied, such as cyan, magenta, yellow, and black. The marking stations 22 are arranged at spaced locations along the paper path in the print zone. Each of the marking stations 22 includes a printhead assembly 30 which applies a marking media to desired locations on the web. In the embodiment of FIG. 12, the printhead assemblies 30 may each include a plurality of printheads that are arranged end to end so as to span the width of the web in the cross-process direction. In alternative embodiments, each marking station may include a single full width array printhead that spans the width of the web in the cross-process direction.

In one embodiment, the marking material applied to the web is a "phase-change ink," by which is meant that the ink is substantially solid at room temperature and substantially liquid when initially jetted onto the web 14. Currently-common phase-change inks are typically heated to about 100° C. to 140° C., and thus in liquid phase, upon being jetted onto the web W. Generally speaking, the liquid ink cools down quickly upon hitting the web W. In alternative embodiments, however, any suitable marking material or ink may be used including, for example, UV curable gel ink, aqueous ink, toner, and the like. As explained below, associated with each printhead is a backing member, such as backing members 32, typically in the form of a bar or roll, which is arranged substantially opposite the printhead on the other side of web. Each backing member is used to position the web so that the gap between the printhead and the web stays at a known, constant distance.

The illustrated conveyor system 12 includes a plurality of guide members such as rollers, which guide the paper web 14 through the print zone past the marking stations, generally through contact with the web. At least one of the rollers 42 is a drive roller which is driven in the process direction by a motor or other suitable drive system (not shown). The drive roller 42 engages a second roller 44 to form a drive nip 46 therebetween. The driven roller 42 applies a driving force to the paper web as it passes through the nip 46. The drive motor is configured for driving the drive roller 42, and hence paper web 14, at a substantially constant preset speed. However, the speed of the driven roller 42 may fluctuate over time, i.e., vary from its preset speed, such that the speed of the web passing through the nip 46 also fluctuates slightly over time. The second roller 44 may be a driven roller or a non-driven (idler) roller. In the illustrated embodiment, the printhead assemblies 30 are spaced along the paper path at various distances upstream from the nip 46.

One or more rollers downstream and/or upstream of the driven roller 42 may be tension rollers. Tension rollers attempt to maintain a constant tension on the web 14, at least in the print zone, without applying a driving force. In one embodiment, rollers 48, 50 may be configured to create a small amount of tension in the web to keep the web taut as it moves through the printing system 10. Accordingly, rollers 48 and 50 may be biased towards the web 14 by tension members, such as springs 52, 54. Although rollers 48, 50 in the schematic diagram of FIG. 12 are shown as having a minimal web wrap or wrap length with respect to web 14, tension rollers in actual implementations may have significantly more web wrap. The wrap length at which the web is in contact with tension rollers, such as rollers 48 and 50, may be any suitable wrap length that enables the tension rollers to impart a desired amount of tension to the web. Additionally or alternatively, the proper level of tension in the web may be created with or without tension members 52 or 54 by controlling the web speed. Generally, however, there might be load cells or tensiometers at one or more locations to aid in the web speed control. Other rollers such as roller 56, upstream of the heads, may serve a guiding function, with or without applying any tension.

The print head assemblies 30 are under the control of a control system 40, which controls the firing of the print heads of the print head assemblies such that an image generated by the second marking station 24 (and subsequent marking stations 26, 28) is superimposed over an image applied by the first marking station 22. The control system 40 may comprise a central processing unit (CPU) which executes instructions stored in associated memory for generating firing times/adjustments for the print heads, or the control system may be another suitable computer controlled device. In one embodiment, the control system 40 may form a part of an overall control system for the imaging device 10, which also provides image data to the marking stations.

As mentioned, in some previously known direct-to-sheet, continuous-web imaging devices, such as the one depicted in FIG. 12, the web guide members, such as rollers and printhead backing members, that define the web path are custom mounted to a large frame. In such previously known systems, changes to the web path configuration, as well as changes in the number of colors and/or the number of printhead arrays incorporated into the imaging device, may require the addition or removal of corresponding rollers, backing members, and the like, as well as modifications to the frame to accommodate the web path changes. For example, continuous web imaging devices are typically designed for a specific number of printheads. A backing member is provided for each printhead that is configured to position the web with respect to the printhead so that the gap between the printhead and the web stays at a known, constant distance. Increasing or decreasing the number of printheads in a previously known imaging device may require the addition or removal of corresponding backing members from the imaging device which may be a time consuming and expensive process.

As an alternative to the use of a web transport system that includes custom mounted web guide members for guiding the web along the web path of the imaging device, and in particular, through the print zone where the printheads are positioned, a modular roll bar assembly has been developed that enables scalable, modular printer platforms for accommodating multiple color and/or printhead configurations in the imaging device. A single modular roll bar assembly, or multiple roll bar assemblies arranged end to end, may be used to define a portion of the web path of an imaging device. In the embodiments described below, one or more modular roll bar assemblies may be used to define the web path through the print zone of the imaging device.

Figure 2:
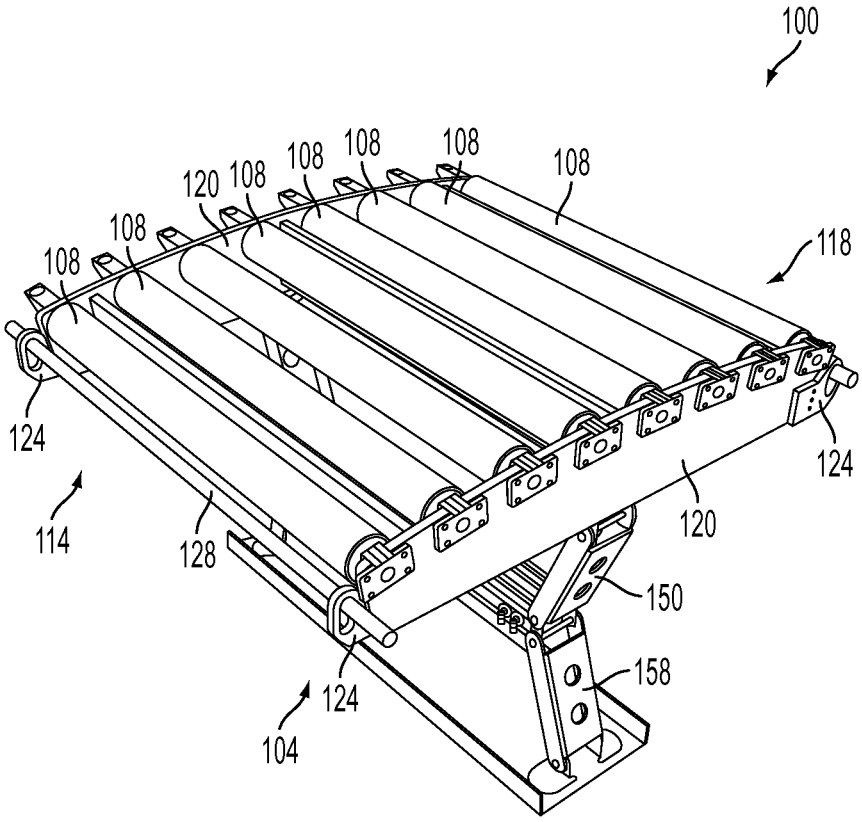
FIG. 2 is a second perspective view of the modular roll bar assembly of FIG. 1.

FIGS. 1 and 2 depict an embodiment of a modular roll bar assembly 100 that may be incorporated into a direct-to-sheet, continuous-web, ink imaging device such as that depicted in FIG. 12. As depicted, the modular roll bar assembly 100 includes a roll bar support sub-frame 104 that is configured to support and precisely position a plurality of roll bars 108 with respect to each other so as to define a portion of a web path of the direct-to-sheet, continuous-web, ink printer. As explained below in relation to FIGS. 3-6, the roll bar support sub-frame 104 of a modular roll bar assembly 100 may be in turn attached to a roll bar assembly main frame 110. A roll bar assembly main frame 110 is configured to support one or more modular roll bar assemblies 100 so that the roll bar assemblies are precisely aligned and positioned with respect to each other to define the web path through the print zone. The roll bar assembly main frame 110 is also configured to support the printheads of the imaging device so that the roll bars 108 of the modular roll bar assemblies provide the necessary gap between each printhead and the web in the print zone.

The roll bars 108 of the modular roll bar assembly are configured to convey a very long (i.e., substantially continuous) web W of "substrate" (paper, plastic, or other printable material) supplied from a web source, e.g., unwinder 18 (FIG. 12) in a process direction P along the web path defined by the roll bars 108 from an entrance end 114 of the modular roll bar assembly 100 to an exit end 118 of the modular roll bar assembly. In the embodiment of FIGS. 1 and 2, the roll bar support frame 104 includes a pair of laterally spaced support members 120 that are configured to support opposing ends of the roll bars 108. The roll bars 108 extend longitudinally between the support members and are spaced apart in the process direction P between the entrance end 114 and the exit end 118 of the modular roll bar assembly.

The roll bars 108 of the modular roll bar assembly 100 are arranged to define a web path having a predetermined shape. In the embodiment of FIGS. 1 and 2, the roll bars 108 are arranged to define a web path having a curved or convex, horizontally oriented shape for use in the print zone of the imaging device. A modular roll bar assembly, however, may be used to define substantially any portion of the web path in the imaging device. The web path shape defined by the roll bars in FIG. 1 is a substantially symmetrical shape so that either end of the modular roll bar assembly may serve as the entrance end and vice versa. In alternative embodiments, the roll bars 108 may be supported by the support members 120 to define any suitable web path shape or geometry.

The roll bars 108 of the modular roll bar assembly 100 are configured to serve as backing members 32 (FIG. 12) for the printheads so that the gap between the printhead and the web stays at a known, constant distance, as described above. In the exemplary embodiment of FIGS. 1 and 2, eight roll bars 108 are incorporated into the assembly 100 to define the curved web path and to provide backing and web positioning for eight printheads. More or fewer roll bars may be provided depending on the number of printheads to which the modular roll bar assembly is configured to provide backing and depending on the desired web path configuration. Each roll bar 108 is positioned to be contacted or partially wrapped by the web as it is being conveyed along the web path defined by the modular roll bar assembly. In one embodiment, the roll bars 108 of the roll bar assembly are idler rollers that include roller bearings (not shown) for enabling idle rotation of the rollers during contact between the web and the rollers as the web is being conveyed in the process direction. Alternatively, the roll bars of the roll bar assembly may comprise non-rotating backer type roll bars as are known in the art that are configured to contact and guide the web as it is being conveyed.

Figure 3:
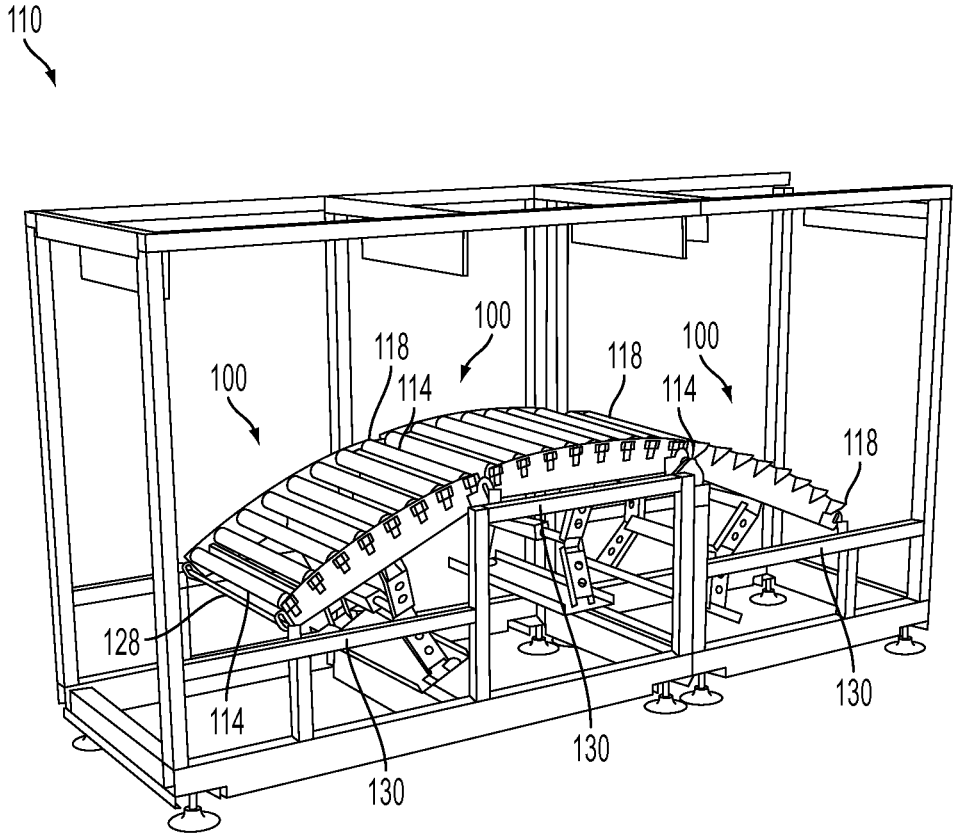
FIG. 3 is a perspective view of three modular roll bar assemblies arranged in an imaging device main frame.

One or more modular roll bar assemblies 100 may be incorporated into an imaging device to provide the print zone web path geometry and printhead backing for multiple printhead configurations. FIG. 3 depicts an embodiment of the print zone portion of a web path of an imaging device formed using three modular roll bar assemblies 100. The roll bar support frame 104 of a modular roll bar assembly 100 may be incorporated or attached to an imaging device in any suitable manner. In one embodiment, one or more modular roll bar assemblies may be mounted to a roll bar assembly main frame 110. As mentioned above, a roll bar assembly main frame 110 may be configured to support one or more modular roll bar assemblies 100 and associated printheads (not shown in FIG. 3) with respect to each other so as to define the print zone portion of the web path in an imaging device. The modular roll bar assemblies 100 are supported by the main frame 110 so that the web paths defined by each of the modular roll bar assemblies 100 define a substantially continuous web path along which a web may be conveyed.

The roll bar support frames 104 and/or the roll assembly main frames 110 may be provided with docking and alignment features to enable precise positioning of a modular roll bar assembly with respect to the main frame and with respect to other modular roll bar assemblies. For example, each modular roll bar assembly may be provided with linkages that enable an end of one modular roll bar assembly to be attached or positioned adjacent to an end of another modular roll bar assembly. As best seen in FIG. 1, the linkages may comprise loops 124 that are positioned at the ends of the lateral support members 120. A rod 128 extends through the loops 124 at each end of the modular roll bar assembly 100. When an end of a first modular roll bar assembly is positioned adjacent an end of a second modular roll bar assembly, a rod 128 may be extended through the loops on the adjacent ends of both the first and second modular roll bar assemblies.

Figure 4:
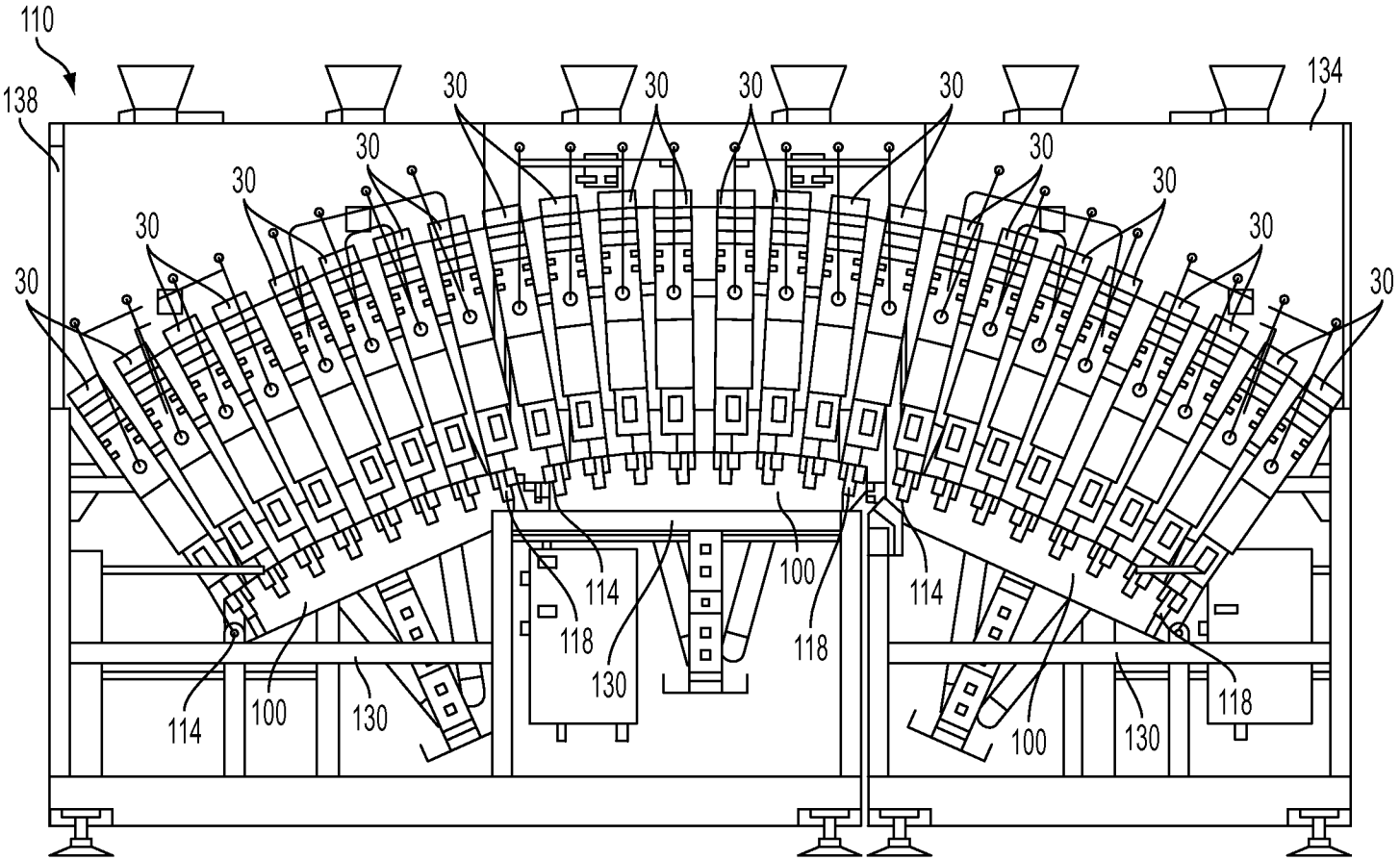
FIG. 4 is a side view of the imaging device main frame of FIG. 3 showing the three modular roll bar assemblies and a plurality of printheads arranged therein.
Figure 5:
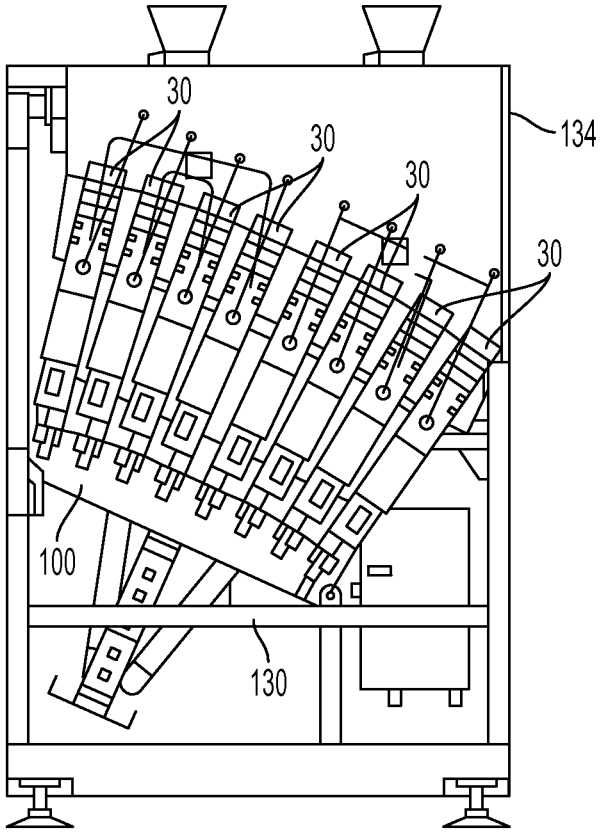
FIG. 5 is a side view of an imaging device main frame for supporting a single modular roll bar assembly.
Figure 6:
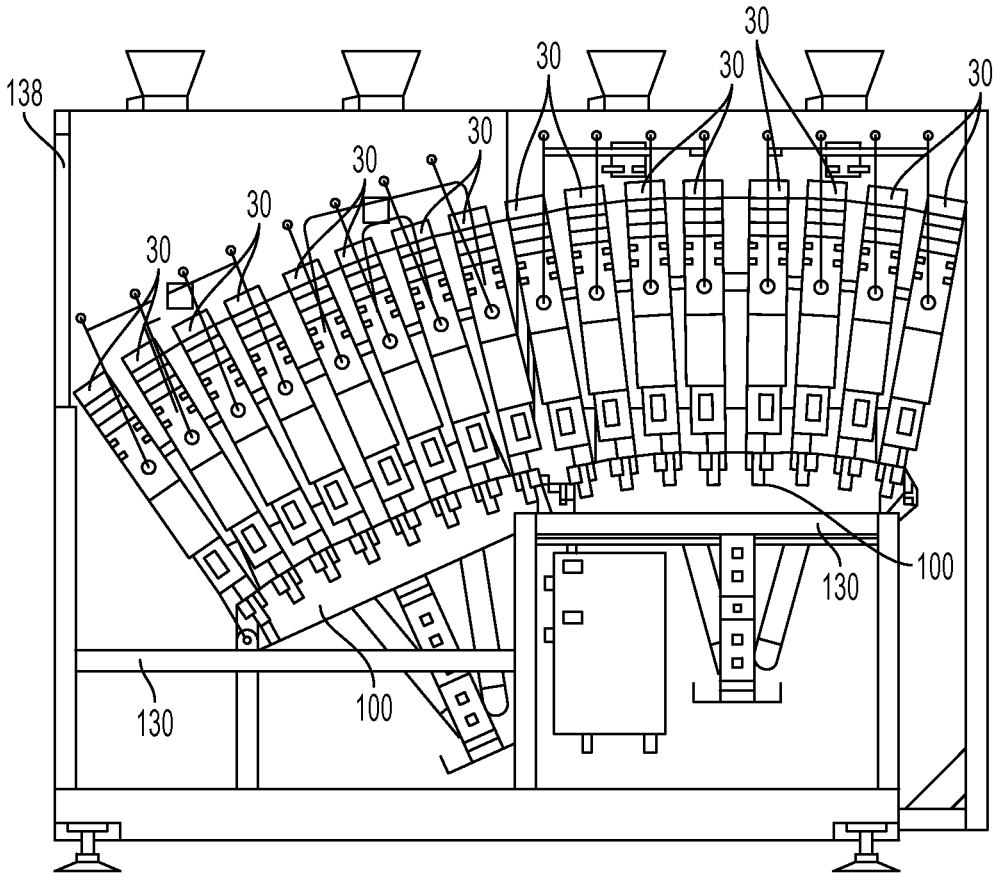
FIG. 6 is a side view of an imaging device main frame for supporting two modular roll bar assemblies.

A main frame 110 may include features, such as support bars 130, that are configured to position the ends 114, 118 of the modular support assemblies 100 at desired locations. In addition, the main frames 110 include printhead attachment features (not shown in FIG. 3) that enable the printheads to be positioned with respect to the roll bars 108 of the modular roll bar assemblies to provide the predetermined gap between the printheads and the roll bars. FIG. 4 shows a side view of the modular roll assembly main frame of FIG. 3 with the printheads 30 attached and positioned with respect to the modular roll bar assemblies 100 to provide the predetermined gap between the rollers 108 of the roll bar assemblies and the printheads 30.

To increase the modularity and scalability of an imaging device, a first roll bar assembly main frame 134 may be configured to support a single modular roll bar assembly, and a second roll bar assembly main frame 138 may be configured to support two modular roll bar assemblies. The modular roll bar assemblies 100 are arranged in the first 134 and second main frames 138 so that the first or second main frame may each be incorporated into an imaging device alone or in combination with each other. For example, the first main frame 134 may be incorporated into an imaging device to provide the print zone web path geometry and backing support for eight printheads 30 (FIG. 5), the second main frame 138 may be incorporated into an imaging device to provide print zone web path geometry and backing support for sixteen printheads 30 (FIG. 6), and the first and the second main frames may be incorporated into an imaging device to provide print zone web path geometry and backing support for twenty-four printheads (FIG. 4).

During operation, precise control of the timing of actuation of the marking stations is necessary so that the separate single color images deposited onto the web by the different print heads are precisely overlaid, or registered, on the web in order to produce the desired output color image. The imaging device may include web speed sensors for detecting the speed of the moving web to control the actuation times for each of the print heads. Web speed may be detected in any suitable manner. For example, as depicted in FIG. 12, an imaging device may include an encoder 62 associated with one or more drive rollers, such as roller 42 or 44. The encoder 62 may be a rotary encoder which is mounted to an axial shaft of the roller 42 (or 44) in a location outwardly spaced from the nip region 46. The encoder 62 may output a fixed number of electrical pulses (clicks) for each rotation of the drive roller 42. Based on a frequency of the clicks, a speed of the paper as it passes through the nip 46 can be determined. For example, web speed may be computed by multiplying the circumference of the driven roller 42 (which may be increased to account for the thickness of the web) by a constant value (a function of the number of clicks per revolution) times the frequency of the clicks (e.g., clicks/second). The encoder information, either as the unprocessed raw data or a calculated web speed, is communicated to the control system 40.

The control system 40 may use the web speed as indicated by the encoder to control the actuation times for each of the print heads. For example, the control system 40 may be configured to actuate each printhead a predetermined number of encoder pulses or clicks after actuation of a first printhead. Absent stretching of the web, the timing of the actuation of the printheads based on the measurement of the speed of the web, e.g., encoder pulses, and the known printhead positions enables a substantially accurate registration of the images on the web applied by the different print heads. A web, such as a length of paper, however, may be a stretchable medium. Therefore, variations in tension applied to the web as well as variations in web speed that may be introduced by the drive roller(s) can cause the web to stretch or change length. Web stretch can affect the time at which a specific portion of the web reaches a printhead or travels between printheads which in turn may cause a particular printhead to print some or all of an image at the wrong location on the web resulting in image misregistration on the web.

In previously known imaging devices, web tension measuring devices, such as load cells or tensiometers, were associated with one or more rollers in or around the print zone to detect the web tension in the print zone. The web tension detected by the web tension measuring devices was then used to adjust the actuation times for the printheads to account for any changes in web tension. Tension monitoring using tensiometers associated with rollers in an imaging device typically requires large web wrap, e.g., 180 degrees, in order to generate a relatively accurate measurement of the tension. At a wrap angle of 180 degrees, however, two times the web tension force is applied to the rollers, and, in particular, to the bearings mounts of the rollers. While such a wrap configuration is preferred for measuring tension, it may be potentially problematic for web registration performance: requiring precisely toleranced roller and bearings to avoid inducing web registration errors (which are exacerbated by large wrap rollers).

Figure 7:
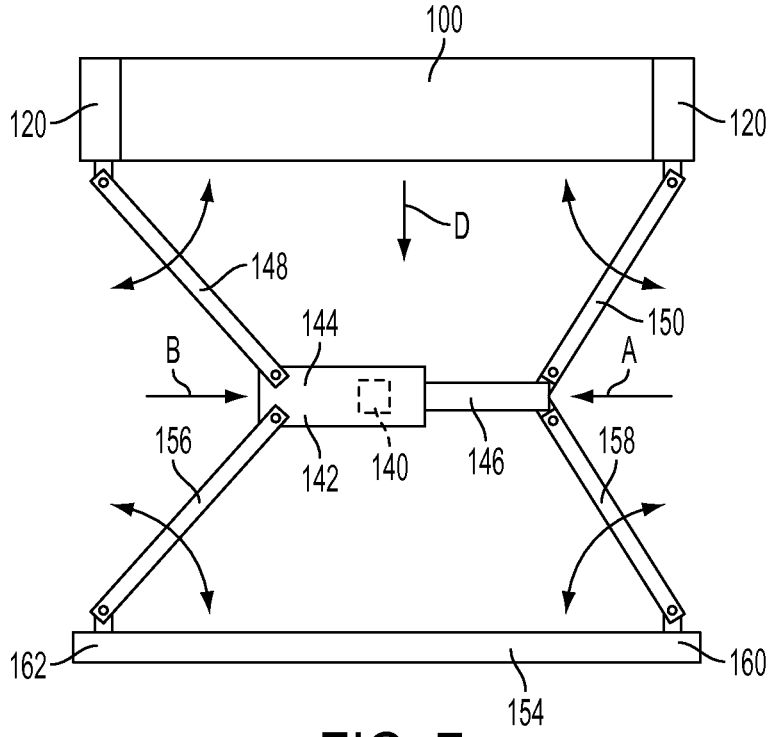
FIG. 7 is a schematic view of the modular roll bar assembly showing the load cell associated with the modular roll bar assembly of FIG. 1.

As an alternative to using tension measuring devices associated with individual rollers in or around the print zone, another aspect of the present disclosure is directed to providing the modular roll bar assemblies 100 with the ability to measure or detect the tension of the web as it is being conveyed through the print zone. Referring now to FIG. 7, in one embodiment, the support frame 104 of a modular roll bar assembly 100 may be operably coupled to a force measuring device 140 that is configured to measure the down force applied to the modular roll bar assembly as a whole. In one embodiment, the force measuring device 140 comprises a conventional load cell or strain gauge that is operably coupled to a piston assembly 144 to measure the axial load applied to the force measuring device, referred to hereafter as the load cell 140. The piston assembly 144 of the modular roll bar assembly may be configured to retract the modular roll bar assembly from the print zone to enable threading of the web through the print zone. Any suitable method or device may be used to enable the piston assembly 144 to adjust the position of the modular roll bar assembly and, in particular, the roll bars of the modular roll bar assembly with respect to the printheads in order to increase the gap or spacing between the printheads and the roll bars so that the web may be fed therethrough.

The load cell 140 is configured to measure the force applied axially in directions A and B to the ends of the piston assembly 144. The piston assembly 144 is attached to the support frame by a pair of upper arms 148, 150. As depicted in FIG. 7, arm 148 extends between one of the lateral support members 120 and the piston receiving end 142 of the piston assembly 144, and arm 150 extends between the other lateral support member 120 and the piston 146 of the piston assembly 144. The arms 148, 150 are each pivotally connected to the support members 120 at one end and pivotally connected to the respective portions of the piston assembly 144 at the other. The piston assembly 144 including the load cell 140 is in turn supported above a base member 154 by a pair of lower arms 156, 158 with arm 158 extending between the piston 146 of the piston assembly 144 and a first lateral end 160 of the base member 154, and arm 156 extending between the piston receiving portion 142 of the piston assembly 144 and a second lateral end 162 of the base member 154. The arms 156, 158 are each pivotally connected to the base member 104 at one end and pivotally connected to the respective portions of the piston assembly 144 at the other.

The upper arms 148, 150 are angled toward each other and the lower arms 156, 158 are angled toward each other so that down force D applied to the modular roll bar assembly 100 by the web or its own weight is transmitted axially in directions A and B to opposing ends of the piston assembly 144 positioned below the modular roll bar assembly. The load cell 140 is configured to output a signal to the control system that is indicative of the down force D applied to the modular roll bar assembly 100 which may be correlated to the tension of the web in the print zone.

During operation, one or more modular roll bar assemblies 100 are docked to the web path and printhead main frame and the steady state loads are transmitted through the load cells which may then be calibrated out of the tension measurements in a known manner. The web may then be threaded through the print zone defined by the modular roll bar assemblies and printheads. The resultant incremental load cell readings may then be correlated to web tension through geometric relationships of the web path, load cell, and docking feature locations. The web tension may then be used by the web drive control system and printing algorithms.

Figure 8:
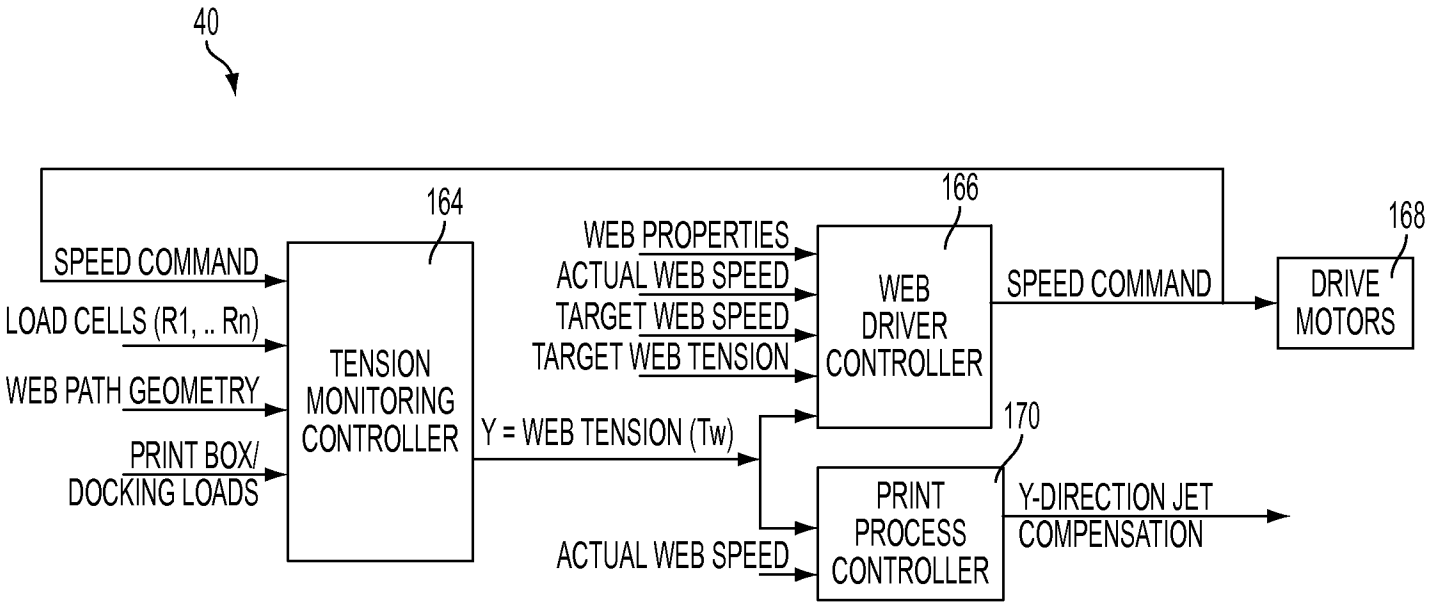
FIG. 8 depicts an embodiment of a control system 40 for controlling web speed and printhead actuation times based on the web tension measurements generated by the load cells of the modular roll bar assemblies.

FIG. 8 depicts an embodiment of a control system 40 for controlling web speed and printhead actuation times based on the web tension measurements generated by the load cells 140 of the modular roll bar assemblies 100 and the speed of the web monitored by one or more web speed sensors. As depicted, the control system 40 includes a tension monitoring controller 164 that receives the speed command (from the web drive controller 166), the load cell readings R1 to Rn (where n is the number of modular roll bar assemblies) from the modular roll bar assemblies, the web path geometry, and steady state loads (e.g., printhead and docking loads) as inputs and based on these inputs is configured to output a signal Tw indicative of the web tension in the print zone. The web tension Tw is received as an input at the web drive controller 166 which also receives web properties, actual web speed as detected using web speed sensors, target web speed, and target web tension as inputs. The web drive controller 166 is configured to generate a speed command that is output to the drive motors 168 of the drive rollers (and fed back to the tension monitoring application) for controlling the speed of the web. The web tension Tw is also received as an input at a print process controller 170 along with the actual speed detected using the web speed sensors. The print process controller 170 may then be configured to adjust the actuation times for one or more of the printheads 30 based on the web tension Tw and the web speed. Accordingly, using the tension measurements that are enabled by the load cells of the modular roll bar assemblies, the drive system 166 may adjust speeds to deliver the desired web tension, and the print process controller 170 can react to expected web stretch to adjust actuation times based on the achieved web tension.

The temperature of the web as well as the uniformity of the temperature of the web in the print zone is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, the target web temperature and web temperature uniformity may be at least partially achieved by using the preheaters (not shown) positioned to heat the web prior to reaching the print zone. To aid in controlling the temperature of the web in the print zone, modular roll bar assemblies 100 may be provided with a thermal control system that enables the roll bars of the modular roll bar assemblies to be thermally regulated, i.e, heated or cooled, to a desired temperature that is configured to maintain the web at a predetermined uniform "ink-receiving" temperature throughout the print zone. The "ink-receiving" temperature may be any suitable temperature that is selected at least in part based the particular type of ink and/or web material used. For example, in embodiments in which the printheads are configured to deposit melted phase change ink onto the web, the ink-receiving temperature may be in a range between approximately 40° C. and approximately 60° C.

Figure 9:
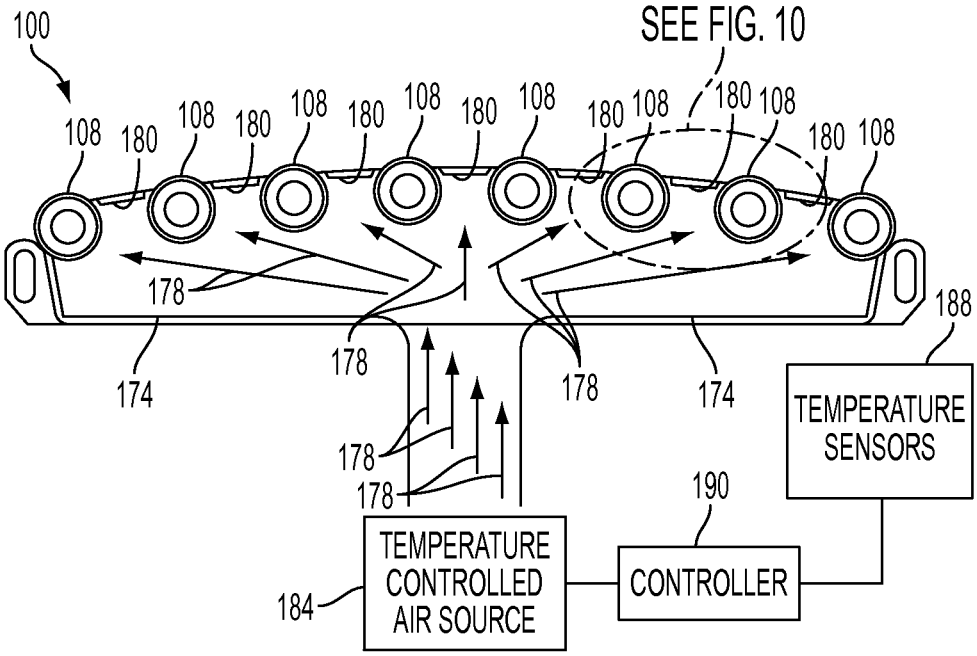
FIG. 9 depicts an embodiment of temperature control system for use with the modular roll bar assembly of FIG. 1.
Figure 10:
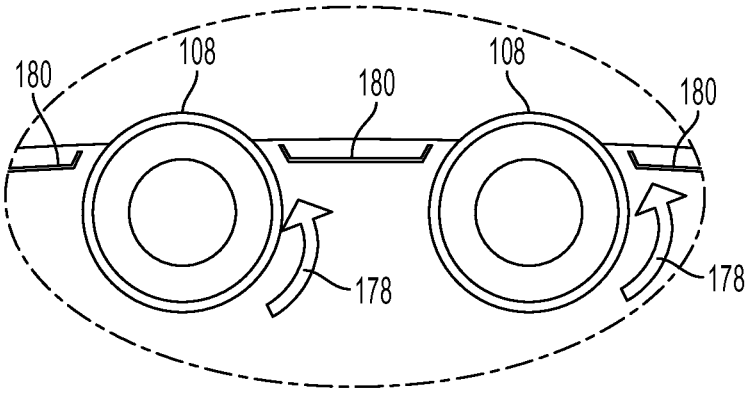
FIG. 10 is a detailed view of the baffles for use with the embodiment of the temperature control system of FIG. 10.

FIG. 9 shows a schematic diagram of an embodiment of a temperature control system that may be utilized in the modular roll bar assembly described above. In this embodiment, the modular roll bar assembly 100 is provided with a plenum 174 positioned below the roll bars 108 that is configured to guide heated or cooled air 178 to the roll bars 108. As used herein, the term "plenum" refers to an at least partially enclosed space positioned below the roll bar to which at least a portion of the roll bars are exposed. The plenum 174 may be provided in any suitable manner such as by using formed ductwork. At least a portion of each roll bar 108 is exposed in the plenum 174 to receive convective heating or cooling (depending on the desired web temperature) from the air 178 in the plenum 174. Baffles 180 may be positioned between the rollers to prevent or limit air flow from escaping from the plenum 174 and to force air entrainment 178 around the roll bars 180 to aid in the convective heating or cooling process. A temperature controlled air source 184 is configured to supply air 178 at a desired temperature and velocity to the plenum 174. The temperature controlled air source 184 may be provided in any suitable manner. For example, the temperature controlled air source 184 may be provided by heating elements, muffin type fans and louvers, or with a manifold system and a remotely located blower.

Temperature sensors 188, such as thermistors or infra-red sensors, may be used to detect web or cavity temperature and provide input to a control system 190. Other print process parameters may be provided to the control system 190 as inputs as well, such as the amount of ink of a given color that is applied to the web at a given time, web media type and velocity, ambient room conditions, and the like. The control system 190 is operably coupled to the temperature controlled air source 184 to adjust airflow and/or air temperature based on the input received from the temperature sensors and print process parameter inputs in order to maintain the web at the desired ink-receiving temperature.

As an alternative to the use of plenums and convective heating or cooling for controlling roll bar temperatures, the roll bars may be configured to be heated using conductive and/or radiative heat transfer using heating elements positioned within the modular roll bar assembly. For example, fixed heating or cooling devices may be mounted as needed with respect to the roll bars to generate the required heating or cooling for the roll bars.

Figure 11:
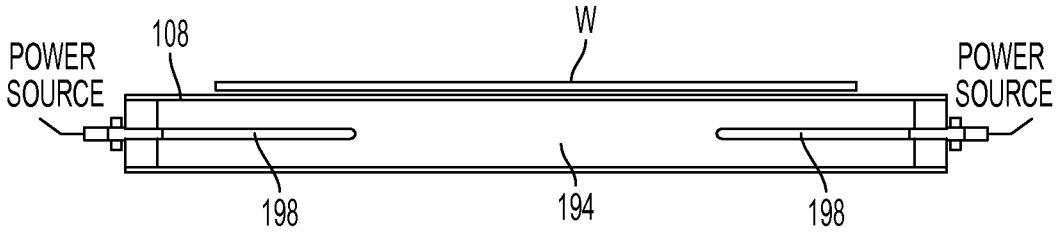
FIG. 11 is a cross-sectional view of an embodiment of a roll bar showing heating elements therein.

In yet another embodiment, the roll bars themselves may be thermally controlled to the appropriate temperature. For example, referring to FIG. 11, the roll bars 108 may be provided a cavity 194 for the flow of liquids therethrough. In this embodiment, the roll bars 108 may each be provided with an internally mounted heater 198, such as an immersion heater. The immersion heater 198 may be threaded into one or both ends of a roll bar 108 as depicted in FIG. 11. The immersion heater 198 is configured to heat the liquid medium in the cavity 194 of the roll bar to a desired temperature. As an alternative to the use of immersion heaters, the roll bars may be configured to have a temperature controlled fluid pumped therethrough from a fluid source (not shown) which enables roll cooling as well as heating depending on the temperature of the fluid.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A modular roll bar assembly for use in a continuous web imaging device, the assembly comprising:

a support frame;

a plurality of roll bars coupled to the support frame to define a web path having a non-linear shape;

a base member and a piston assembly;

a first upper arm pivotably coupled to a first lateral side of the support frame at one end and pivotably coupled to a piston receiving portion of the piston assembly at an opposing end;

a second upper arm pivotably coupled to a second lateral side of the support frame at one end and pivotably coupled to a piston of the piston assembly at an opposing end;

a first lower arm pivotably coupled to a first lateral end of the base member at one end and pivotably coupled to the piston receiving portion of the piston assembly at an opposing end;

a second lower arm pivotably coupled to a second lateral end of the base member at one end and pivotably coupled to the piston of the piston assembly at an opposing end;

the first and the second upper arms and the first and the second lower arms being configured to translate the down force applied to the plurality of roll bars to an axial load on the piston assembly;

a load cell operably coupled to the support frame and to the piston assembly, the load cell being configured to generate a signal indicative of a down force applied to the support frame, the signal being generated with reference to the axial load on the piston assembly; and a controller operably coupled to the load cell to receive the signal generated by the load cell and to correlate the down force applied to the support frame indicated by the signal to a tension measurement value for the continuous web.

2. The modular roll bar assembly of claim 1, the support frame including docking and alignment structures at the entrance end and the exit end to enable removable attachment to another modular roll bar assembly or to an imaging device main frame.

3. The modular roll bar assembly of claim 1, the plurality of roll bars comprising a plurality of idler rollers.

4. The modular roll bar assembly of claim 1, the plurality of roll bars comprising a plurality of backer bars.

5. The modular roll bar assembly of claim 1, further comprising:

a source of thermally controlled air configured to supply air at a predetermined temperature and velocity; and a plenum positioned in the support frame configured to guide the air from the source to the plurality of roll bars.

6. The modular roll bar assembly of claim 5, further comprising:

a web temperature sensor configured to detect a temperature of the continuous web; and a controller operably coupled to the web temperature sensor and the source, the controller being configured to control power to the source based on the detected temperature of the continuous web.

7. The modular roll bar assembly of claim 1, the plurality of roll bars each including at least one thermal element configured to generate thermal energy in the corresponding roll bar.

8. The modular roll bar assembly of claim 1, the controller further comprising:

a web drive controller configured to generate a web speed command based on the tension measurement value.

9. The modular roll bar assembly of claim 1, the controller further comprising:

a print process controller configured to adjust printhead actuation times based on the tension measurement value.

* * * * *